US006371209B1

(12) United States Patent
Allyn et al.

(10) Patent No.: US 6,371,209 B1
(45) Date of Patent: Apr. 16, 2002

(54) CASING INSTALLATION AND REMOVAL APPARATUS AND METHOD

(76) Inventors: John F. Allyn, 270 Ashpohtag Rd.; Walter G. Allyn, 260 Ashpohtag Rd., both of Norfolk, CT (US) 06058

( * ) Notice: Subject to any disclaimer, the term of this patent is extended or adjusted under 35 U.S.C. 154(b) by 0 days.

(21) Appl. No.: 09/453,727

(22) Filed: Dec. 2, 1999

Related U.S. Application Data

(60) Provisional application No. 60/129,582, filed on Apr. 16, 1999.

(51) Int. Cl.[7] ..... B25D 9/04; B25D 17/08

(52) U.S. Cl. ..... 166/340; 175/171; 175/298; 173/90

(58) Field of Search ..... 166/338, 340, 166/358, 360; 175/5, 171, 296, 298; 173/90, 91

(56) References Cited

U.S. PATENT DOCUMENTS

| | | | | |
|---|---|---|---|---|
| 2,218,285 A | | 10/1940 | Jellik, Jr. | 222/81 |
| 3,239,016 A | | 3/1966 | Alexander | 173/164 |
| 3,888,218 A | | 6/1975 | Bonewitz | 123/198 R |
| 4,585,256 A | | 4/1986 | Rassieur et al. | 285/190 |
| 4,691,790 A | | 9/1987 | Reichman et al. | 175/67 |
| 5,305,837 A | * | 4/1994 | Johns et al. | 175/296 |
| 5,957,220 A | * | 9/1999 | Coffman et al. | 173/91 |
| 6,047,778 A | * | 4/2000 | Coffman et al. | 173/91 |
| 6,155,361 A | * | 12/2000 | Patterson | 175/296 |

OTHER PUBLICATIONS

Parts List For "Quantum Leap®" Downhole Drills; Revision 3, 1996, Ingersoll–Rand Company.

Instructional Manual For Downhole Drills; Revision 2; 1996, Ingersoll–Rand Company.

* cited by examiner

*Primary Examiner*—David Bagnell
*Assistant Examiner*—Tara L. Mayo
(74) *Attorney, Agent, or Firm*—McCormick, Paulding & Huber LLP

(57) ABSTRACT

A downhole well drilling apparatus includes an above-ground mast and an axially elongated generally cylindrical pneumatic hammer drill supported by the mast and mounted in an axially vertical above-ground position. An installation and removal adapter mounted on the lower end of the pneumatic hammer drill couples the hammer drill to a pipe string and maintains a movable part of the hammer drill in an operative condition at all times thereby enabling the hammer drill to operate while rotational torque and upward directed force are simultaneously applied to the operating hammer drill by the apparatus during removal of a casing from a downhole position. Hammer operation is controlled by a manually operable air supply valve.

19 Claims, 3 Drawing Sheets

CASING INSTALLATION AND REMOVAL APPARATUS AND METHOD

CROSS REFERENCE TO RELATED APPLICATION

This application relates to Provisional U.S. patent application Serial No. 60/129,582, filed Apr. 16, 1999, the filing date of which is claimed here.

FIELD OF THE INVENTION

This invention relates in general to downhole drilling apparatus and deals more particularly with an improved apparatus and method for installing well casing or removing well casing or a drill rod which may be stuck in a bore hole.

BACKGROUND OF THE INVENTION

A downhole drilling apparatus of the type with which the present invention is concerned utilizes an air hammer drill mounted at the downhole end of a pipe string to drive a drill bit. The hammer drill includes an axially elongated cylindrical hammer casing or barrel which is mounted on and depends from the lower end of the pipe string. A hammer chuck threadably connected in fixed position to the lower end of the hammer barrel carries an axially vertically reciprocally moveable drill bit having an upwardly facing bit shoulder disposed in opposing relation to a downwardly facing arresting surface on the lower end of the drill chuck. The bit shoulder is normally spaced a substantial distance below the arresting surface, as for example, 2 to 3 inches below the latter surface when the drill bit is in an extended position, wherein it projects downwardly from the chuck. When air under pressure is supplied to the hammer drill with the drill bit in the latter position the hammer remains inoperative causing the pressurized air to be exhausted from the hammer barrel and in a downhole direction through an axially extending passageway in the drill bit. Hammer operation will not commence until the drill bit moves upwardly within the drill chuck and to a retracted position relative to the barrel.

During a normal drilling operation when no substantial resistance is encountered by the drill bit the bit remains in its extended position, the hammer remains inoperative. However, when the drill bit encounters resistance, as, for example, a rock formation, the drill bit moves in an axially upward direction and to a retracted position relative to the hammer barrel. The upward movement of the drill bit causes the upper end of the bit shank to engage and elevate a moving part or piston contained within the hammer barrel to a hammer operating position. When the movable part or piston attains an operating position within the hammer barrel, hammer operation commences and continues until the drill bit passes the obstruction and drops to an extended position which allows the moving part to drop to an inoperative position within and relative to the hammer barrel, thereby arresting hammer operation.

Thus, an air operated hammer which comprises a part of a typical downhole drilling apparatus such as hereinbefore described is adapted to sense an obstruction in its path of its downward movement within a bore hole and operate automatically in response to the sensing of such a resistance.

Heretofore, the aforedescribed hammer action has been employed to aid in well casing installation. A rotary casing adapter connected to an above-ground portion of a drilling apparatus is generally employed to rotate a well casing during casing installation where no substantial resistance is anticipated. However, when it becomes necessary to drive the well casing into the earth the rotary head casing adapter is removed from the apparatus and replaced by a hammer drill of the type hereinbefore generally described. The hammer drill is fitted with a worn drill bit of a conventional type which has been provided with a substantially smooth downwardly facing impacting surface. The hammer drill is lowered to bring the impacting surface into impacting engagement with a horizontally disposed protective plate or like member resting on the exposed upper end of the well casing. The modified drill bit moves upwardly to a retracted position within the hammer barrel causing hammer operation to commence and continue for as long as downward pressure is maintained on the hammer drill relative to the well casing being installed. However, a hammer drill arranged in the aforedescribed manner cannot be employed to apply upwardly directed hammering force to a well casing to remove the casing from the ground because upward movement of the hammer drill renders the tool inoperative.

Accordingly, it is a general aim of the present invention to provide an improved apparatus and method for installing a well casing or removing a well casing or stuck drill rod from the earth and utilizing both rotary and air percussion actions, which actions may be either individually or simultaneously employed.

SUMMARY OF INVENTION

In accordance with the present invention a well drill casing installation and removal adapter for a hammer drill comprises a unitary structure which includes a cylindrical main body portion having a male hammer chuck thread for mating coengagement with a female hammer chuck thread within a lower end of a hammer drill barrel. An integral diametrically enlarged annular flange portion disposed immediately below the main body portion defines a radially disposed and upwardly facing abutment surface for engaging a downwardly facing end surface on the lower end of the hammer drill barrel. An integral diametrically reduced coaxial cylindrical portion projects upwardly from the main body portion and has a generally radially disposed upwardly facing bearing surface for engaging and holding an axially movable part of the hammer drill in an elevated condition within the hammer drill barrel corresponding to an operative condition of the hammer drill to maintain the hammer drill in its operative condition at all times. A coupling means is provided on the lower end of the adapter for connecting the air hammer to the upper end of a pipe string. A central bore extends coaxially through the adapter and opens through its upper and lower ends. A blow tube is coaxially received within an upper end of the central bore and extends axially upward for some distance beyond the abutment surface at the upper end of the adapter for cooperating with the axially movable part of the hammer drill and provides an air passageway which communicates with the bore and with another air passageway which extends through the movable part of the hammer drill.

DETAILED DESCRIPTION OF PREFERRED APPARATUS AND METHOD

Figure 1:
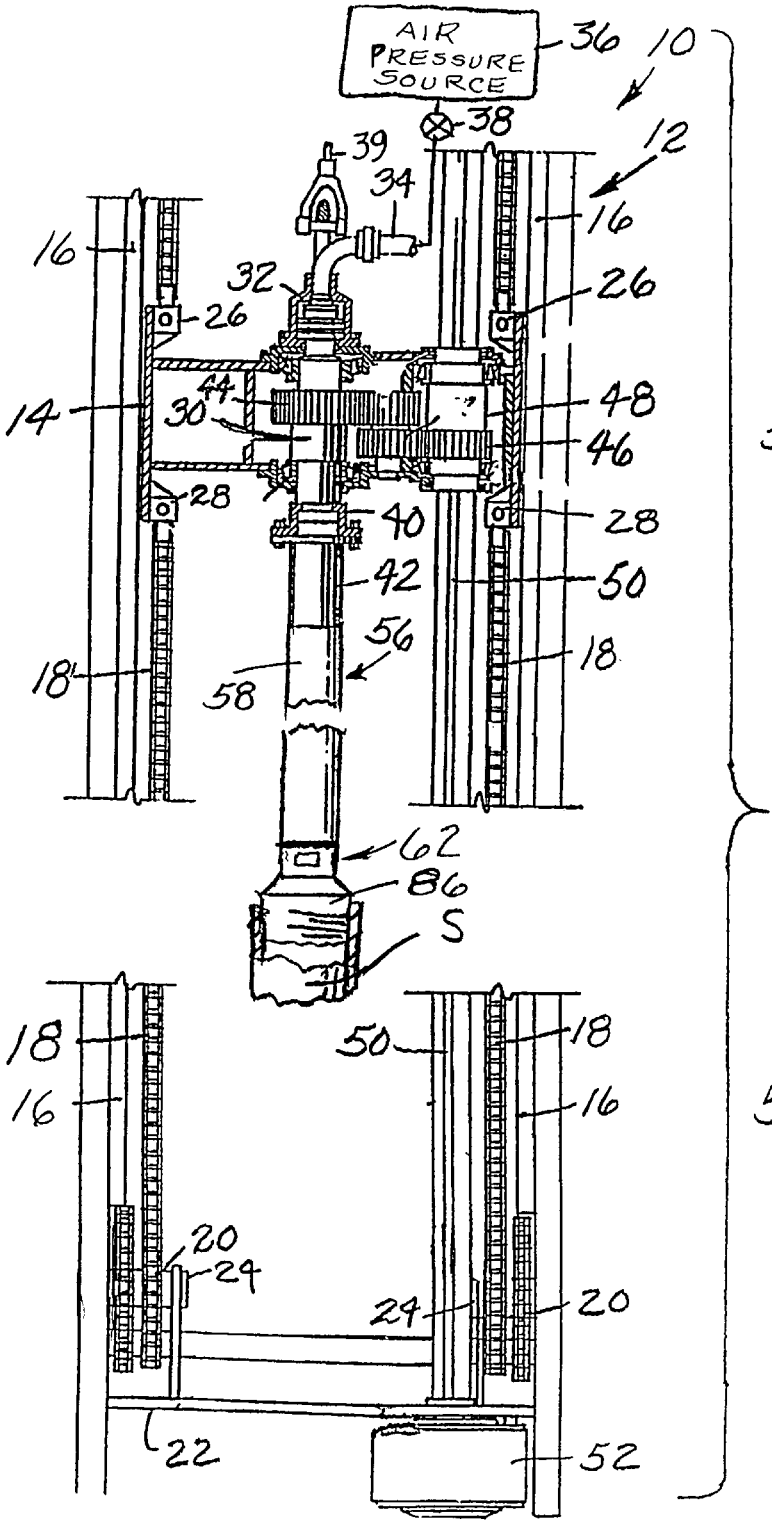
FIG. 1 is a fragmentary elevational view of a downhole drilling apparatus of a type used in practicing the invention.

The present invention is concerned with improvements in a well drilling machine of the type having an above-ground mast or tower with a top-drive rotary head or rotary-table drive capable of sinking a well casing and feeding and retracting a downhole drill and a method for utilizing such apparatus to install or remove well casing or the like.

In the drawings and in the description which follows the invention is illustrated and described with reference to an above-ground portion of a drilling machine of the afore-described type indicated generally by the numeral 10. The illustrated apparatus 10, shown in FIG. 1, includes a mast or tower indicated generally at 12 and having a traveling head or transmission 14 slideably guided for up and down travel along horizontally opposed and vertically extending guide ways 16, 16 mounted at opposite sides of the mast 12. The traveling head 14 is raised and lowered on the guides by chains 18, 18 which comprise part of a hoisting mechanism and operate over sprockets 20, 20 located at opposite sides of the mast 12 above a mast base or transverse platform 22 and over similar sprockets located proximate the top of the mast 12, but not shown. The sprockets 20, 20 are mounted on stub shafts 24, 24 and connected by a hoist drive chain to an associated drive mechanism (not shown). The opposite ends of the chains 18, 18 are connected to the upper and lower sides of the traveling head 14 by lugs 26, 26 and 28, 28.

A tubular spindle 30 carried by the traveling rotary drive head 14 is connected at its upper end by a swivel head 32 to a conduit 34 which receives drilling air under pressure or compressed air, from a supply source indicated at 36. A manually operated control valve 38 is connected in the air supply conduit 34 between the compressed air supply source 36 and the traveling head 14 for controlling the supply of pressure to the drilling machine 10. Compressed air is supplied to a pipe string which is connected to the apparatus during a normal drilling operation, in a manner well known in the art. A hoist cable 39 is also connected to the swivel head 32, substantially as shown.

The lower end of the tubular spindle 30 extends for some distance below the traveling drive head 14 and carries a coupling 40 coupled to a spud 42 which has a bore through it which communicates the tubular spindle 30 to receive air under pressure from the air supply conduit 34.

The tubular spindle 30 is rotated within the head 14 to effect rotation of a drill pipe or well casing which may be coupled to the head 14 by the spud 42. A gear 44 mounted on the tubular spindle 30 is drivingly connected by a gear train to another gear 46 mounted on a fixed position on a drive sleeve 48 journaled at its upper and lower ends in bearings mounted in the housing of the traveling head 14. The drive sleeve 48 is splined to engage grooves in an axially elongated vertically extending drive shaft 50 which extends substantially the full height of the mast 12 near one of the chains 18 which carry the traveling head 14. The drive shaft 50 is mounted at its ends on the mast and is driven by a gearhead 52 connected to a power source (not shown). Selected operation of the gearhead 52 imparts rotary motion to the spud 42, all of which is generally conventional in the well drilling art. A further disclosure of a well drilling apparatus of the type hereinbefore described is found in U.S. Pat. No. 3,239,016, to Alexander, issued Mar. 8, 1966, and entitled, Drill Pipe Sections and Method of and Apparatus for Automatically Breaking Out the Connections Thereof, which is hereby adopted by reference as part of the present disclosure.

In accordance with the present invention a downhole hammer drill, modified in accordance with the invention, is attached to the lower end of the spud 42 to depend from it. Hammer drills of various kinds may be used in practicing the invention. However, and by way of example, the hammer drill shown in the illustrated embodiment 10 and indicated generally by the numeral 56 comprises an Ingersol Rand QUANTUM LEAP downhole drill, manufactured and marketed by Ingersoll-Rand Company, Roanoke, Va., 24019–5198, and may comprise any one of several models such as Models: QL4; QL50; QL55QM; QL60; QL60HC; QL65QM & QL80, QL8HC. The backhead or upper end portion of the illustrated hammer drill 56 is threadably connected to the spud 42 which supports it in depending position relative to the transmission or rotary head 14.

Figure 2:
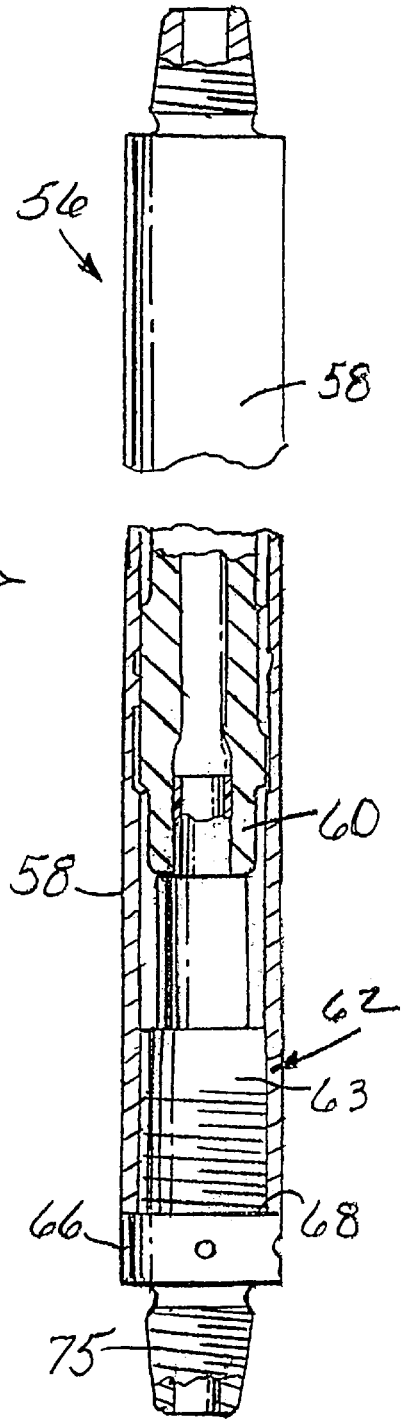
FIG. 2 is a somewhat enlarged elevational view of the hammer drill illustrated in FIG. 1 shown partially in axially vertical section and fitted with a casing installation and removal adapter embodying the invention.

Further referring to the drawings, the hammer drill 56 which is typical of a pneumatic type hammer drill which may be used in practicing the invention and which has been modified in accordance with the invention is shown in somewhat further detail in FIG. 2 and includes an axially elongated generally cylindrical tubular hammer barrel casing or barrel 58. A piston 60 supported for reciprocal axial sliding movement within the tubular hammer barrel 58 cooperates with porting, which may, for example, be defined by one or more radially inwardly open grooves or ports formed in the inner sidewall of the hammer barrel 58, to provide alternate air flow paths through the hammer barrel casing for air under pressure introduced into the barrel 58 through the upper or backhead end of the pneumatic hammer drill 56.

A drill bit assembly (not shown) is normally mounted at the lower end of the hammer drill 56 and includes an internally splined drill chuck threadably engaged within and mounted in fixed position on the lower end of the hammer barrel. A mating splined drill bit which comprises a part of the bit assembly is releasably retained within the drill chuck by bit retaining rings for limited axial movement within and relative to the drill chuck and the hammer drill barrel 58. The drill bit is constructed and arranged for vertical axial movement between retracted and extended positions. In fully extended position, the drill bit projects downwardly from the drill chuck allowing the piston 60 to attain its lowermost position within the hammer drill barrel 58. In the latter position of the piston 60 relative to the ports or grooves in the barrel 58 an air flow path is established which allows air under pressure, which enters the hammer barrel 58 through the upper or backhead end of the barrel, to bypass the piston 60 and be exhausted through the drill bit and/or through one or more exhaust port openings which may be provided in the drill bit chuck.

When the downhole drill 56 is fitted with a drill bit assembly and lowered to the bottom of a bore hole, causing the drill bit to move upwardly from its extended position toward its retracted position 60 within the hammer drill barrel, the upper end of the drill bit shank engages a portion of the lower surface of the piston and elevates the piston within the cylindrical barrel 58. When the upwardly moving piston 60 reaches a position where the piston by-pass ports formed in the hammer drill barrel are closed air pressure acts upon the piston to reverse the direction of piston movement. When this condition occurs normal downhole drill operation resumes automatically, and the piston becomes operative. In its operative condition the piston reciprocates, striking a blow on the upper end of the drill bit shank during each downward piston movement. In the normal downhole drilling operation hole cleaning is provided by exhaust air which is directed downwardly through the center hole in the drill bit during the exhaust cycle which occurs during upward movement of the piston.

It will now be apparent that when the drill bit encounters the bottom of a bore hole or other obstruction and moves upwardly within the chuck the upper end of the bit shank engages and raises the piston 60 to a predetermined operative position within and relative to the hammer drill barrel 58 whereby operation of the piston commences. Piston operation continues until upwardly directed force ceases to act upon the drill bit and the piston attains an inoperative position within the barrel below its predetermined operative position.

Although the drill bit assembly, hereinbefore described, is not employed in practicing the present invention, a general understanding of the positioning of the drill bit and its influence on the operation of the piston is essential to a proper understanding of the apparatus which comprises the present invention, and which is hereinafter further described.

Figure 3:
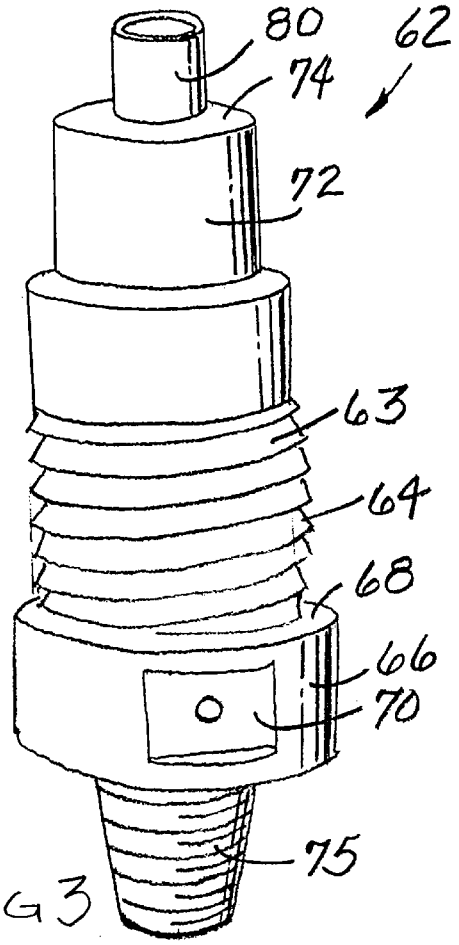
FIG. 3 is a somewhat further enlarged perspective view of the casing installation and removal adapter.
Figure 4:
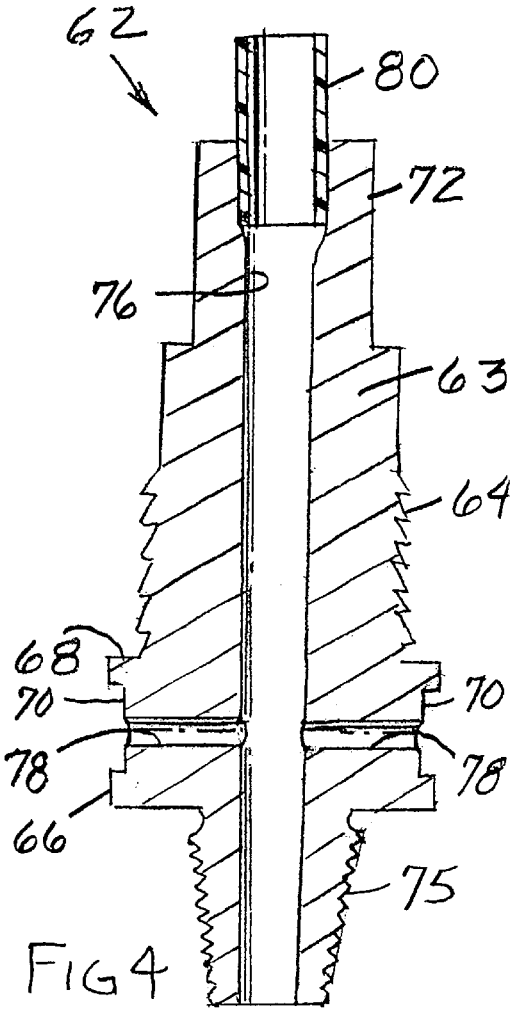
FIG. 4 is an axially vertical sectional view through the casing installation removal adapter shown in FIG. 3.

Further, and in accordance with the invention, a well casing installation and removal adapter is assembled with the hammer drill barrel 58 in place of the drill bit assembly normally employed during downhole drilling operations. The casing installation and removal adapter, indicated generally at 62 and best shown in FIGS. 3 and 4, essentially comprises a generally cylindrical unitary structure, preferably formed from steel, and having a cylindrical main body portion 63 threaded with a male hammer chuck thread 64 adapted for mating coengagement with the female hammer chuck thread within the lower end of a hammer drill barrel 58, as illustrated in FIG. 2. An integral diametrically enlarged annular flanged portion 66 disposed immediately below the main body portion 63 defines a generally radially disposed and upwardly facing abutment surface 68 for engaging a downwardly facing end surface on the lower end of the hammer drill barrel 58. Diametrically opposed wrench engaging flats 70, 70 are provided on the adapter flanged portion 66 for use during assembly of the adapter 62 with the hammer drill barrel 58.

An integral diametrically reduced coaxial cylindrical portion 72 projects upwardly from the adapter main body portion 63 and defines a preferably substantially flat generally radially disposed and upwardly facing bearing surface 74 for engaging a portion of the lower end of a moving part of a hammer drill such as the piston 60 of the hammer drill 56. The cylindrical portion 72 cooperates with the moving part or piston 60 to maintain the piston 60 in an elevated and operative position within the hammer drill barrel 58 when the casing installation and removal adapter 62 is assembled with the hammer drill 56. The illustrated adapter 62 further includes an integral coaxial coupling or connecting portion 75 which projects downwardly from the flanged portion 66 and which is externally threaded with an API (American Petroleum Institute) thread, which may be employed to connect the hammer drill to a pipe string, as shown in FIG. 1. A generally cylindrical bore 76 which serves as an exhaust port extends coaxially through the adapter 62 and opens through its upper and lower ends. Preferably, one or more additional exhaust ports, such as shown at 78, communicate with the central bore 76 and open generally radially outwardly through the sidewall of the flange portion 66, substantially as shown. A plastic blow tube 80 received within the upper end of the bore 76 extends upwardly for some distance beyond the, surface 74 and forms an upward extension of the latter bore. The upper end of the blow tube is adapted to be received within a bore in a hammer drill piston such as the piston 60, in a manner well known in the art.

It should now be noted that the distance between the radially disposed abutment surface 68 on the flange 66 and the bearing surface 74 on the upper end of the adapter provides a means for elevating the movable part or piston 60 to and maintaining it in a predetermined operative position so that the tool will be operative at all times when sufficient air under pressure is introduced into the hammer drill casing 58 through the backhead or upper end portion of the casing by operating the manual air control valve 38, shown in FIG. 1.

In accordance with a process for sinking a well casing in accordance with the present invention, a hammer drill modified in the manner hereinbefore described to include a casing installation and removal adapter, such as the adapter 62, is attached to the spud 42 of an above-ground portion of well drilling apparatus, such as shown in FIG. 1. A rotary casing adapter indicated at 86 is connected to the casing installation and removal adapter 62. The upper end of a well casing section, indicated by the letter S, is connected in depending position to the rotary casing adapter 86.

If no unusual problem is anticipated in sinking the well casing S, the well casing installation operation may proceed by operating the rotary head 14 to rotate the well casing S as it is lowered into the earth by the hoisting mechanism. However, if resistance is encountered the air operated hammer 56 may be operated independently of the rotary head 14 and the hoisting mechanism by opening the air control valve 38, as necessary, to supply sufficient air under pressure to the air hammer 56 to operate the air hammer. If desired, both the rotary head 14 and the air hammer 56 may be operated simultaneously.

Since the pneumatic hammer 56 fitted with the adapter 62 is operative at all times when sufficient air under pressure is supplied to it, the hammer may be employed to vibrate the well casing S while the well casing is being withdrawn from the earth by lifting force applied by the hoisting mechanism. As previously noted, the hammer 56 and the rotary head 14 may be operated either independently or simultaneously during the casing removal operation and either and both may be operated while lifting force is being applied to the casing S by the hoisting mechanism or the hoist cable 39 if the situation warrants such action.

While the invention has been illustrated and described with reference to a well casing installation and removal operation it should be understood that the aforedescribed operating procedures may also be employed to remove a stuck drill rod by the application of hammer action and either and both upward and rotary force, as may be necessary, and such procedures are contemplated within the scope of the present invention.

The casing installation and removal adapter 56 hereinbefore described includes provision for exhausting pressure air from the hammer in both axial and radial directions. However, there may be instances where it is desired to direct the full force of the exhausted air pressure from the hammer in only one direction. Such an arrangement is shown in FIGS. 5 and 6 where parts corresponding to parts previously described bear the same reference numeral as the previously described part and a letter "a" suffix.

Figure 5:
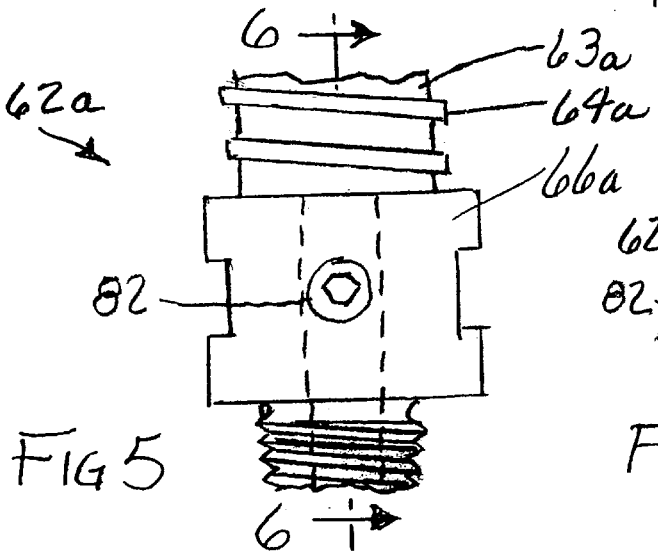
FIG. 5 is fragmentary elevational view of another casing installation and removal adapter.
Figure 6:
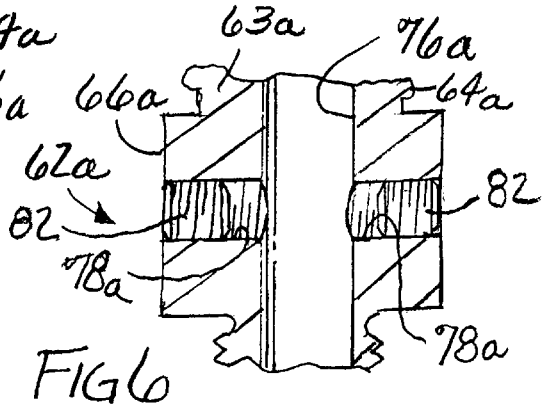
FIG. 6 is a fragmentary axially vertical sectional view through the casing installation and removal adapter of FIG. 5

The casing installation and removal adapter 56*a* shown in FIGS. 5 and 6 is substantially identical in most respects to the adapter 56 hereinbefore described, but differs from the adapter 56 in that the outer end of each exhaust port 78*a* is threaded to receive a threaded plug 82, plugs equal in number to the ports being provided for use with the adapter 56*a*. When plugs are used with the adapter 56*a*, air will be exhausted only through the central bore 76 and downwardly from the adapter. If a reverse arrangement is desired wherein air is to be exhausted in one or more radial directions, a threaded plug or other suitable means may be provided for blocking the lower end of the bore 76. Air is then exhausted through the remaining radially disposed exhaust ports which are left in open condition.

The illustrated embodiments of the invention hereinbefore described are provided with male couplings or connecting portions at the lower ends thereof which carry male API connecting threads. However, female connecting threads or other connection arrangements may be provided on the casing installation and removal adapter as hereinafter described.

Figure 7:
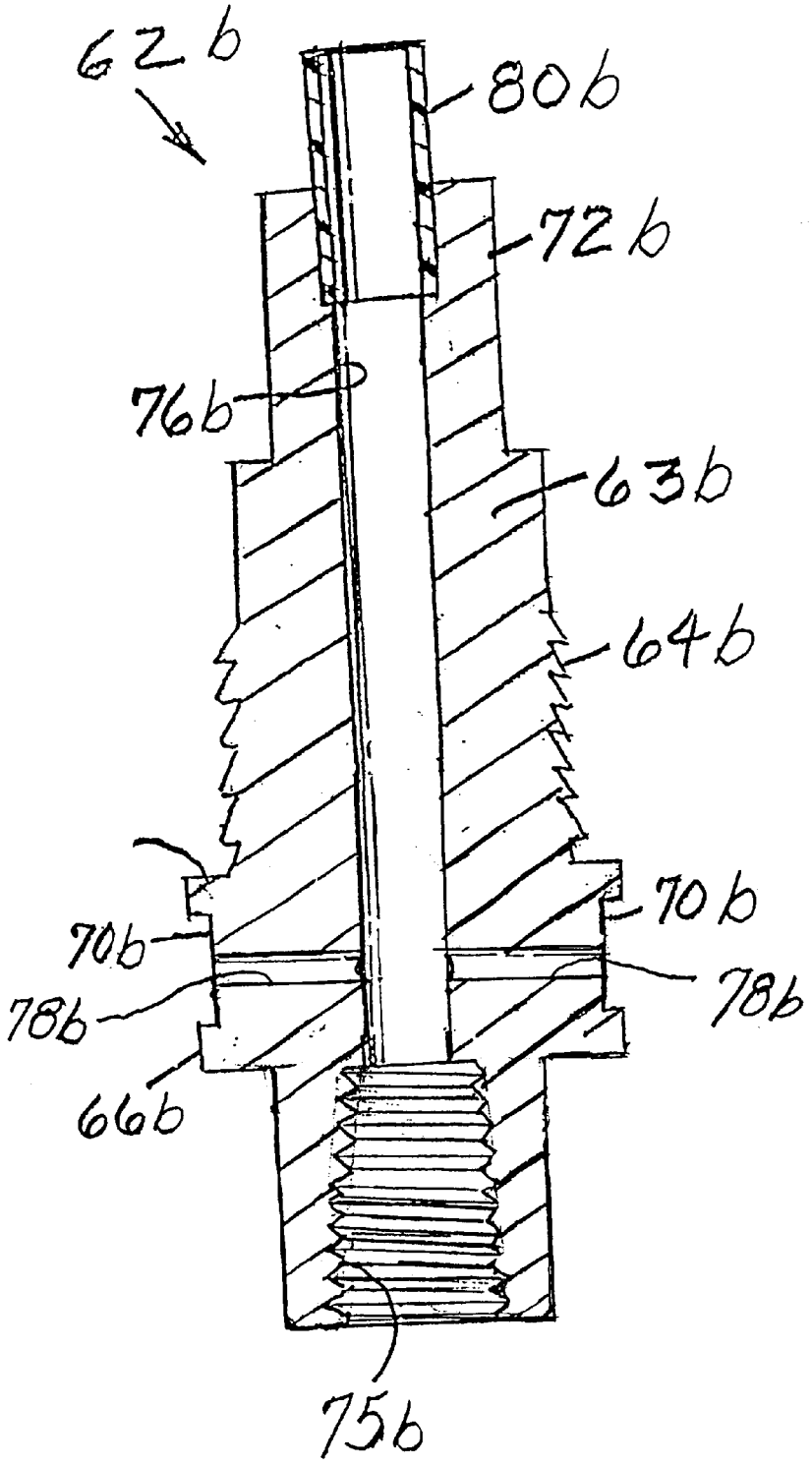
FIG. 7 is similar to FIG. 4 but shows still another casing installation and removal adapter embodying the invention.

Referring now to FIG. 7 another well casing installation and removal adapter embodying the invention is indicated generally at 62*b*. The adapter 62*b* is similar in many respects to the previously described adapter 62 and portions of the adapter 62*b* which correspond to portions of the previously described adapter 62 bear the same reference numerals and a letter b suffix and will not be hereinafter further described.

The adapter 62*b* differs from the adapter 62 in the construction and arrangement of its lower-end portion. Specifically, the adapter 62*b* lacks a male thread on its downwardly projecting lower end portion. Instead, the adapter 62*b* has an internally threaded opening 75*b* at its lower end for coupling the adapter to a well casing. A coupling member such as the coupling member 86 shown in FIG. 1 and provided with an upwardly projecting threaded coupling portion (not shown) may be employed to establish connection between the air hammer 56 and a well casing which comprises a part of a pipe string S, as shown in FIG. 1. An internal or female API thread is preferably provided on the inner surface of the opening 75*b* for mating engagement with such a standard coupling member.

We claim:

1. A well casing installation and removal adapter for a hammer drill having an axially elongated axially vertically oriented barrel comprising: a unitary axially elongated generally cylindrical stucture including a cylindrical main body portion having a male hammer chuck thread for mating coengagement with a female hammer chuck thread within a lower end of a hammer drill barrel, an integral diametrically enlarged annular flange portion disposed below the main body portion and defining a radially disposed and upwardly facing abutment surface for engaging a downwardly facing end surface on the lower end of the hammer drill barrel, an integral diametrically reduce coaxial cylindrical protion projecting upwardly from said main body portion and having an upwardly facing bearing surface for engaging and holding a reciprocally axially movable part of the hammer drill in an elevated position within the barrel corresponding to an operative condition of the hammer drill to maintain the hammer drill in said operative condition at all times, coupling means at the lower end of said adapter for connecting said adapter to a pipe string, said casing installation and removale adapter having a generally cylindrical central bore extending coaxially therethrough and opening through an upper end and a lower end thereof, and a blow tube coaxially received within an upper end of said cnetral bore and extending axially upward for some distance beyond said abutment surface and forming an upward extension of said central bore wherein said flange portion has a generally coaxial sidewall and at least one exhaust port extending through said sidewall and communicating with said central bore, said at least one exhaust port for releasing compressed air.

2. A well casing installation and removal adapter as set forth in claim 1 wherein said adapter includes at least one plug and means for releasably securing said at least one plug in said at least one exhaust port to form a closure for said at least one exhaust port.

3. A well casing installation and removal adapter as set forth in claim 2 wherein said means for releasably securing said at least one plug comprises a male thread on said at least one plug and a female thread within said at least one exhaust port for coengagement with said male thread.

4. A well casing installation and removal adapter as set forth in claim 1 wherein said adapter has diametrically opposed wrench engaging flats thereon.

5. A well casing installation and removal adapter as set forth in claim 4 wherein said flats are defined by said flange portion.

6. A well casing installation and removal adapter as set forth in claim 1 wherein said coupling means is further characterized as means defining a connecting thread.

7. A well casing installation and removal adapter as set forth in claim 6 wherein said thread comprises an American Petroleum Institute (API) thread.

8. A well casing installation and removal adapter as set forth in claim 6 wherein said coupling means comprises an integral coaxial connecting portion projecting downwardly from said flange portion and said connecting thread comprises a male thread defined by said connecting portion.

9. A well casing installation and removal adapter as set forth in claim 6 wherein said coupling means comprises an internally threaded opening at the lower end of said adapter.

10. A well casing installation and removal adapter for a hammer drill comprising: a unitary axially elongated generally cylindrical structure including a cylindrical main body portion having a male hammer chuck thread for mating coengagement with a female hammer chuck thread within a lower end of a hammer drill barrel, an integral diametrically enlarged annular flange portion disposed immediately below the main body portion and defining a radially disposed and upwardly facing abutment surface for engaging a downwardly facing end surface on the lower end of the hammer drill barrel, an integral diametrically reduced coaxial cylindrical portion projecting upwardly from said main body portion and having a generally radially disposed upwardly facing bearing surface for engaging and holding a reciprocally axially movable part of the hammer drill in an elevated position within the barrel corresponding to an operative condition of the hammer drill to maintain the hammer drill in said operative condition at all times, an intrgral coaxial connecting portion projecting downwardly from said flange portion and externally threaded with a thread for connection with a pipe string, said casing installation and removal adapter having a generally cylindrical central bore extending coaxilly therethrough and opening through an upper end and a lower end thereof, and a blow tube coaxially received within an upper end of said central bore and extending axially upward for some distance beyond said abutment surface and forming an upward extention of said bore wherein said flange portion has a generally coaxial side wall and at least one exhaust port extending through said side wall and communicating with said central bore, said at least one exhaust port for releasing compressed air.

11. A combination comprising a downhole drilling apparatus including an above-ground mast and an air operated hammer drill supported by said mast in an above ground position and having an axially vertically elongated cylindrical barrel and an axially reciprocally movable part disposed within the barrel for movement between a lowered position wherein the hammer drill is inoperative and a raised position corresponding to an operating condition of the hammer drill, said apparatus including hoisting means for raising and lowering said hammer drill, and a rotary driving means for applying torque to said hammer drill to rotate said hammer drill about its axis, and a casing installation and removal adapter mounted in fixed position corresponding to an operating condition of said hammer drill to maintain said hammer drill in operating condition at all times, and measn for coupling said hammer drill to a casing whereby an upwardly directed pulling force may be applied to said hammer drill by said hoisting means while said hammer drill is operating.

12. The combination as set forth in claim 11 including independently operable means for operating said rotary driving means and said hoisting means to apply rotational torque and/or axial force to said hammer drill while said hammer drill is operating.

13. The combination set forth in claim 12 wherein said independently operable means are simultaneously are operable to apply rotational torque and axially upwardly directed force to said hammer drill while said hammer drill is operating.

14. The combination as set forth in claim 11 wherein said axially directed force is further characterized as axially upwardly directed force.

15. The combination as set forth in claim 11 including means for operating said hammer drill independently of said rotary drive means and said hoisting means.

16. The combination as set forth in claim 15 wherein said means for operating said hammer drill independently is further characterized as a manually operable air control valve connected to a source of pressurized air for supplying air under pressure to the air hammer drill.

17. A method for removing a well casing from a downhole position comprising the steps of providing a drilling apparatus having an above ground mast, an air operated hammer drill, hoisting means for raising and lowering the hammer drill, and rotary driving measn for applying torque to the hammer drill to rotate it about a vertically oriented axis; mounting the hammer drill in an above ground position on the apparatus; positioning the apparatus to generally coaxially align the vertical axis of the hammer drill with the casing to be removed; attaching a casing installation and removal adapter to the lower end of the hammer drill for holding a moveable part of the hammer drill in an elevated condition corresponding to an operative condition of the hammer drill to maintain the hammer drill in an operative condition at all times; coupling the casing to the lower end of the hammer drill; supplying air under pressure to the hammer drill to operate the drill; and operating the hoisting means to apply upwardly direction force to the casing while the hammer drill is operating.

18. A method for removing a casing from a downhole position as set forth in claim 17 including the additional step of operating the rotary driving means to apply rotational torque to the casing while the hoisting means is being operated to apply upwardly directed force to the casing and the hammer drill is operating.

19. A method for removing a casing from a downhole position as set forth in claim 17 wherein the step of coupling is further characterized as coupling the casing to the casing installation and removal adapter.

* * * * *